US008813826B2

(12) United States Patent
Gatenby et al.

(10) Patent No.: US 8,813,826 B2
(45) Date of Patent: Aug. 26, 2014

(54) METHOD OF AND APPARATUS FOR CASTING METAL SLAB

(71) Applicant: Novelis Inc., Toronto (CA)

(72) Inventors: Kevin Michael Gatenby, Kingston, CA (US); Edwin Stanley Luce, Kingston, CA (US)

(73) Assignee: Novelis Inc., Atlanta, GA (US)

( * ) Notice: Subject to any disclaimer, the term of this patent is extended or adjusted under 35 U.S.C. 154(b) by 0 days.

(21) Appl. No.: 14/105,943

(22) Filed: Dec. 13, 2013

(65) Prior Publication Data

US 2014/0096929 A1 Apr. 10, 2014

Related U.S. Application Data

(62) Division of application No. 13/765,500, filed on Feb. 12, 2013, now Pat. No. 8,662,145.

(60) Provisional application No. 61/614,118, filed on Mar. 22, 2012.

(51) Int. Cl.
*B22D 11/16* (2006.01)

(52) U.S. Cl.
USPC ..... 164/481; 164/432

(58) Field of Classification Search
USPC ..... 164/481, 482, 429–434
See application file for complete search history.

(56) References Cited

U.S. PATENT DOCUMENTS

| | | | | |
|---|---|---|---|---|
| 4,061,177 | A | 12/1977 | Sivilotti et al. | |
| 4,193,440 | A | 3/1980 | Thorburn et al. | |
| 4,537,243 | A | 8/1985 | Hazelett et al. | |
| 6,354,364 | B1 * | 3/2002 | Roder et al. | 164/472 |
| 6,446,703 | B1 * | 9/2002 | Roder et al. | 164/472 |
| 6,755,236 | B1 | 6/2004 | Sivilotti et al. | |
| 6,910,524 | B2 | 6/2005 | Sivilotti et al. | |

(Continued)

FOREIGN PATENT DOCUMENTS

| | | |
|---|---|---|
| JP | 04123847 | 4/1992 |
| JP | 2011245526 | 12/2011 |
| WO | 2013138925 | 9/2013 |

OTHER PUBLICATIONS

International Search Report and Written Opinion mailed May 17, 2013 in PCT Application No. PCT/CA2013/0905194.

(Continued)

*Primary Examiner* — Kevin E Yoon

(74) *Attorney, Agent, or Firm* — Kilpatrick Townsend & Stockton LLP

(57) ABSTRACT

Embodiments of the invention relate to a method and apparatus for continuously casting a metal slab. The method involves continuously introducing molten metal into an inlet of a casting cavity defined between advancing casting surfaces, cooling the metal in the cavity to form a metal slab, and discharging the slab from the cavity through an outlet. The casting surfaces have an ability to remove heat from the metal but this ability is reduced, thus reducing heat flux, for at least one of the casting surfaces in a region of the cavity spaced from both the inlet and the outlet and extending transversely to the casting direction. This reduced ability to remove heat is relative to such ability of the casting surface in immediately adjacent upstream and downstream regions of the cavity. The apparatus may be a twin belt caster or other form of continuous caster modified to perform the method.

9 Claims, 4 Drawing Sheets

(56) References Cited

U.S. PATENT DOCUMENTS

| | | | |
|---|---|---|---|
| 2007/0215314 | A1 | 9/2007 | Fitzsimon et al. |
| 2010/0307713 | A1 | 12/2010 | Ito et al. |
| 2013/0248137 | A1 | 9/2013 | Gatenby et al. |

OTHER PUBLICATIONS

U.S. Appl. No. 13/765,500, "Notice of Allowance" dated Nov. 7, 2013.

* cited by examiner

METHOD OF AND APPARATUS FOR CASTING METAL SLAB

CROSS REFERENCE TO RELATED APPLICATION

This application is a divisional of U.S. patent application Ser. No. 13/765,500, filed Feb. 12, 2013, which claims the priority right of prior provisional patent application No. 61/614,118 filed Mar. 22, 2012, by applicants named herein. The entire contents of application No. 61/614,118 and application Ser. No. 13/765,500 are specifically incorporated herein by this reference.

BACKGROUND OF THE INVENTION

1. Field of the Invention

This invention relates to a method of and apparatus for casting metal to form metal slabs. More particularly, the invention relates to continuous casting methods and apparatus in which the metal is cast in a casting cavity formed between spaced confronting casting surfaces that are advanced in a casting direction between an inlet for and an outlet from the casting cavity.

2. Background Art

Elongated relatively thin metal slabs (sometimes also referred to as cast strips or bands) may be produced by continuous casting techniques in equipment such as twin-belt casters, rotating block casters, twin-roll casters, and the like. Metals that have moderate or relatively low melting temperatures, e.g. aluminum, magnesium, zinc, and alloys having these elements as principal ingredients, are particularly suitable for this kind of casting, but other metals may also be cast in such equipment on occasion. Heat is withdrawn from the metal in the casting cavity by and through the casting surfaces so that the metal cools and produces a solid slab having a thickness similar to the spacing between the casting surfaces. Side dams are usually provided between the casting surfaces at their extreme lateral edges to prevent loss of metal and to define the side edges of the casting cavity. A molten metal injector or launder is used to continuously introduce molten metal into the casting cavity through the inlet and the solidified slab is continuously withdrawn from the casting cavity through the outlet by the motion of the casting surfaces. The casting surfaces are continuously recirculated externally of the casting cavity from the outlet to the inlet so that they are continuously available for use.

The casting surfaces are generally actively cooled so that they are capable of withdrawing heat from the metal in the casting cavity. This can be done, for example, by applying a coolant, e.g. a cooling liquid or possibly a gas, to recirculating elements on which the casting surfaces are formed, which elements normally have good heat conduction properties so that heat passes through them from the metal to the coolant. In the case of twin-belt casters, for example, cooling liquid (usually water containing appropriate additives) is applied to the rear surfaces of recirculating casting belts in the regions where the belts confront each other to form the casting cavity so that heat is conducted from the casting cavity through the casting surfaces and the belts and is removed by the coolant. Examples of twin-belt casters of this kind are described in U.S. Pat. No. 4,061,178 which issued to Sivilotti et al. on Dec. 6, 1977; U.S. Pat. No. 4,193,440 which issued to Thorburn et al. on Mar. 18, 1980; and U.S. patent publication No. 2010/0307713 which published on Dec. 9, 2010 in the names of Ito et al. The disclosures of these patents are specifically incorporated herein by this reference.

When operating apparatus of this kind, it is usual to maintain an even cooling of the casting surfaces at all locations along the casting cavity in the direction of casting and to keep the casting surfaces in firm contact with the molten or solidifying metal at all such locations in order to maintain the ability of the casting surfaces to withdraw heat from the metal undergoing casting. Since the metal may contract slightly as it cools and solidifies on its passage through the casting cavity, the casting surfaces may be made to converge slightly towards each other in the direction from the inlet to the outlet so that firm contact with the metal is maintained throughout the casting cavity. However, when metal is cast in this way, the rate at which heat is withdrawn from the metal (i.e. the heat flux through the casting surfaces) is initially high because of the large difference in temperature between the molten metal undergoing casting and the cooled casting surfaces and by good conformal contact between the molten metal and the casting surfaces. As casting proceeds further, the outer surfaces of the embryonic metal slab are cooled more quickly than the central parts of the metal slab since temperature equalization within the metal takes time. As the outer slab surfaces cool, heat flux through the casting surfaces declines because of the reduction in the temperature differential between the casting surfaces and the adjacent metal. Eventually, the outer surfaces of the metal begin to solidify, even though the central parts may still be molten. It is necessary to ensure that the casting cavity has a sufficient length (distance between the inlet and the outlet in the casting direction) to allow for sufficient heat withdrawal before the cast slab is discharged through the outlet. In practice, the casting cavity must be of such a length that the exit temperature of the slab (generally as measured at the outer surface) is low enough that the slab can be subjected to further handling and processing without deformation or damage. Of course, the necessary length of the casting cavity is also linked to the rate of throughput of the metal in that, for a given metal or alloy, a slower rate of metal throughput will allow more time for heat withdrawal and will therefore allow the casting cavity to be made shorter than would be the case for a higher rate of metal throughput. Twin-roll casters, in particular, employ a very short casting cavity that is formed essentially by the nip between the rolls.

The need for slow rates of metal throughput and/or long casting cavities results in higher equipment and production costs than would be the case if rates could be increased and/or casting cavities shortened. Longer casting times and cavity lengths may also require greater amounts of coolant to be employed. There is therefore a desire to design and operate casting apparatus of this kind in such a way that casting rates can be further increased and/or casting cavities shortened.

SUMMARY OF THE EXEMPLARY EMBODIMENTS

One exemplary embodiment of the invention provides a method of continuously casting a metal slab by (a) continuously introducing molten metal into an inlet of a casting cavity defined between spaced confronting casting surfaces advancing in a direction of casting; (b) providing the casting surfaces with an ability to remove heat from the molten metal in the casting cavity to cause the molten metal to solidify and thereby form a fully- or partially-solid metal slab within the casting cavity; (c) continuously discharging the metal slab from the casting cavity through an outlet of the casting cavity; and (d) reducing the ability of at least one of the casting surfaces to remove heat from the metal in a region of the cavity spaced from both the inlet and the outlet and extending transversely to the direction of casting, the ability being reduced relative to the ability of the at least one casting surface to remove heat from immediately adjacent upstream and downstream regions of the casting cavity.

By the term "reducing the ability of a casting surface to remove heat" we mean that the cooling effect of the surface on the metal in the cavity is reduced from a maximum or normal level that it would otherwise have in the particular casting equipment and environment but for the reduction. The heat flux through a casting surface at any point in the casting cavity is determined by such factors as the heat conductivity of the casting member on which the surface is formed, the active cooling applied to the member, e.g. by liquid coolant applied to the opposite side of the member, the difference in temperature between the active cooling means and the metal in the cavity, and the like. The heat flux through the casting surfaces varies (i.e. normally reduces in a non-linear fashion) as the metal progresses through the casting cavity in any continuous casting operation. This is because the metal cools as it progresses through the casting cavity. However, the ability of the casting surfaces to remove heat from any region of the casting cavity can be reduced so that less heat flows out of the cavity than would otherwise be the case in that region. This can be done, for example, by allowing a casting surface to move slightly away from the central plane of the casting cavity (i.e. a plane situated at the midpoint of the cavity between, and extending generally parallel to, the casting surfaces) in a particular region compared to other regions of the cavity, particularly when compared to the immediately adjacent regions in the upstream and downstream directions. When this is done in a region where the metal has a solid outer shell, the casting surface moves somewhat away from the metal surface and thus produces an insulating space between metal and surface that reduces the ability of the surface to remove heat and thus reduces heat flux through the surface. Other ways of reducing the ability of the surface to remove heat include increasing the temperature of the coolant fluid used to cool the casting surface in the region of interest, reducing the rate of flow of the coolant, or providing partial insulation of the surface from the coolant, e.g. by introducing a gas into the liquid coolant or between the liquid coolant and the surface in the region of interest. Such measures are not carried out in the immediately adjacent regions, so the abilities of the surface(s) in those other regions remain unaffected and produce the "normal" or "maximum" heat flux for the casting equipment and conditions in those regions.

The casting surfaces are normally provided as pairs of confronting but separated surfaces moving in tandem in a casting direction. One or both of these casting surfaces may be provided with a region in which the ability of the surface(s) to remove heat is reduced. When both surfaces are modified in this way, the regions where the ability is reduced may coincide for both surfaces (so that the regions are mutually confronting across the cavity) or may be different, e.g. the region of reduced ability for the top surface may be further along the cavity than the region for the bottom surface, or vice-versa. Likewise, the regions may be of the same length in the casting direction, or of different lengths. This depends on the effect desired to be produced, bearing in mind that one desired effect is to reduce the slab temperature more efficiently (i.e. within a shorter casting distance or at higher casting speeds) than would otherwise be the case. This is based on the unexpected finding that, by temporarily reducing the ability of at least one of the casting surfaces to remove heat in a mid region of the casting cavity, the overall efficiency of heat withdrawal may be improved. Without wishing to limit the scope of the invention to any theory, it is believed that this may be because the reduction of the ability of the casting surface to remove heat in one region allows the temperature of the outer parts of the slab to rise (e.g. when heated from hotter internal parts), and this temperature rise enables more effective heat removal to occur further along the casting cavity where the casting surfaces have a normal ability to remove heat.

Another exemplary embodiment provides casting apparatus for continuously casting a metal slab from molten metal, having (a) spaced confronting casting surfaces forming a casting cavity therebetween and adapted to be advanced in a direction of casting from an inlet to an outlet of the casting cavity; (b) molten metal feed apparatus for introducing molten metal into the casting cavity through the inlet; and (c) cooling equipment for cooling the casting surfaces enabling the surfaces to withdraw heat from the casting cavity thereby to solidify the molten metal and form a fully- or partially-solid metal slab within the cavity. The casting cavity has a region thereof extending transversely to the direction of casting and spaced from both the inlet and the outlet between immediately adjacent upstream and downstream regions of the casting cavity, wherein means are provided to reduce an ability of at least one of the casting surfaces to withdraw heat from the molten metal or metal slab in the region compared to an ability of the at least one casting surface to withdraw heat from the casting cavity within the immediately upstream and downstream regions thereof.

The elongated casting members may each be supported by a plurality of supports engaging the surfaces of the opposite sides thereof either directly or via films of the coolant, and the ability of the casting surface(s) to remove heat within the region may be reduced by moving the supports back in a direction away from the opposite side of the casting members relative to the positions of supports in the other regions. In conventional casting of this kind, the supports may have generally flat support surfaces engaging the opposite side surfaces of the casting members, and the flat support surfaces of the various supports are generally coplanar along the entire length of the casting cavity. In one exemplary embodiment of the invention, the flat support surfaces of the supports for one of the casting members are coplanar as indicated above except for those in the one region of the casting cavity where the ability of the casting surface to remove heat is to be reduced. In this region, the flat surfaces of the supports are offset from the common plane of the other supports (thereby increasing their spacing from the central plane of the casting cavity) by a certain distance away from the opposite sides of the casting member, thereby causing the casting surface in this region to press less firmly against the metal slab or to move slightly out of contact with the metal and further away from the central plane of the casting cavity. The flat surfaces of the supports in the indicated region may all be coplanar with each other or may adopt a profile stepping first away from and then towards the opposite side surface of the casting member considered in the direction of casting.

As mentioned above, the casting cavity in the exemplary embodiments has an inlet and an outlet. The inlet is considered to be the position where the casting surfaces first become generally parallel, or the point at which the molten metal first contacts the casting surfaces, whichever occurs first in the casting operation. The outlet is generally considered to be the position at which the casting surfaces move permanently out of contact with the cast metal, or are made to diverge significantly from the metal slab.

As mentioned above, in a conventional casting operation of the kind to which the present invention may be applied, heat is extracted through the casting surfaces as the metal being cast passes from the inlet to the outlet of the casting cavity, during which time it changes from a molten liquid to a cast solid. As the metal cools due to heat removal, the heat flux through the casting surfaces tends to decrease because of the reduced temperature differential between the metal adjacent to the casting surfaces and the temperature of the coolant or other means used to extract heat through the surfaces. In such casting operations, there is therefore a "natural" or conventional reduction of heat flux and a "natural" reduction of metal temperature as the distance from the inlet to the outlet of the casting cavity increases. Such reductions are rarely linear in profile. In embodiments of the present invention, this "natural" reduction of heat flux and/or metal temperature is modified by affecting the normal or conventional ability of one or both of the casting surfaces to remove heat from a particular region of the casting cavity. In one exemplary embodiment, the normal or conventional ability of a casting surface to remove heat is determined by the degree or rate of cooling applied directly or indirectly to the casting surface, and this cooling, e.g. in the form of a liquid coolant applied to the casting surface through a casting element (e.g. a casting belt), is normally constant along the length of the casting cavity, e.g. the same volume of coolant per unit time is applied to the reverse of the casting element throughout the casting cavity. However, the ability of the casting surface to remove heat is also determined by the efficiency of contact between the casting surface and the metal being cast and this efficiency is significantly reduced if the metal being cast moves out of contact with the casting surface after a time, e.g. due to solidification and contraction of the metal. These are ways in which the ability of the casting surfaces to remove heat is naturally or conventionally limited during casting. Conventionally, steps are taken to keep the cooling and efficiency of contact equal throughout the length of the casting cavity, e.g. by ensuring that the casting surfaces are perfectly planar and, if necessary, causing the casting surfaces to converge slightly towards the outlet of the casting cavity, so that contact pressure is maintained as the metal slab cools and contracts. In contrast to such conventional casting techniques, and the natural or conventional limitation of the ability of casting surfaces to remove heat from the metal, embodiments of the present invention seek to change the conventional pattern of heat removal along the casting cavity by providing a region spaced from both the inlet and the outlet, where the ability of the casting surface(s) to remove heat is further reduced. This can be done, for example, by affecting the conventional pattern of cooling or of contact efficiency. Put another way, rates of heat extraction along a casting cavity are generally intended to be at a maximum at any point along the cavity, even though the rates may vary from point to point due to temperature differentials and natural changes in contact efficiency. Embodiments of the present invention provide a region where the heat flux is reduced compared to the maximum heat flux achievable in that region when the casting is carried out in the same casting equipment under the same casting conditions, but without influence from the present invention. An advantage of this is an unexpected increase in the overall efficiency of heat removal from the metal being cast.

As mentioned, regions of reduced heat extraction may be provided for one or both casting surfaces. If such regions are provided for both casting surfaces, the regions may be of the same size (in the casting direction) and positioned at the same distance along the casting cavity, but this is not necessary. In fact, if the slab temperature is not symmetric about its horizontal centre plane (which is often the case given the tendency of gravity to maintain preferential contact of the metal with the bottom belt), then there is no reason to have the reduced heat extraction symmetric about that same plane. To the contrary, it may be more desirable to have a different length or position of the region of reduced heat flux on the top belt compared to the bottom belt, e.g. to attempt to equalize the effects of such heat flux reduction on both sides of the cast slab.

The region(s) of reduced heat flux may extend the region fully across the width of the casting cavity, or only part way across. Theoretically, the rate of heat extraction should be the same across the entire width of the caster but, in practice, this is not so, as demonstrated by the existence of an uneven slab exit temperature profile. For simplicity of operation, however, it would be preferably to reduce the heat flux uniformly across the entire width of the caster.

It appears that the reduction of the ability of the casting surfaces in the stated regions increases the surface temperature of the slab in the region of reduced heat flux, and it is theorized that this temperature increase drives the increase in heat flux further down the cavity in the direction of casting. At the very least, the surface temperature may simply not fall as rapidly as it otherwise would (without heat flux modification), again leading to an increased heat flux further down the cavity.

In the case of a twin belt caster, the region of reduced heat flux of the casting surface(s) can be produced by offsetting belt-supporting cooling nozzles from the central plane of the casting cavity in the desired region. An effective offset for the nozzles may be as little as 0.5 mm, and is preferably about 1 mm (±25%). In practice, the effective range depends upon the physical relationship between the nozzles and the belt. If the nozzles are offset too far, they may eventually lose their ability to pull on the belt and change its path, and thus impart no further effect on the heat flux reduction. Moreover, the stability of belt movement may be adversely affected because of the lack of effective support. The amount by which the nozzles are offset normally produces a smaller movement of the belt surface from the central plane, e.g. an offset of 1 mm in the nozzles may produce a movement of the belt surface by only 0.4-0.5 mm. In general, the offset of the nozzles should be effective to produce a desirable reduction of heat flux through the belt surface, but no more than is necessary to achieve this effect. This may vary from one caster/nozzle design to another and can be determined by simple trial and experimentation.

BRIEF DESCRIPTION OF THE DRAWINGS

Exemplary embodiments of the invention are described in more detail in the following with reference to the accompanying drawings, in which.

DETAILED DESCRIPTION

Figure 1:
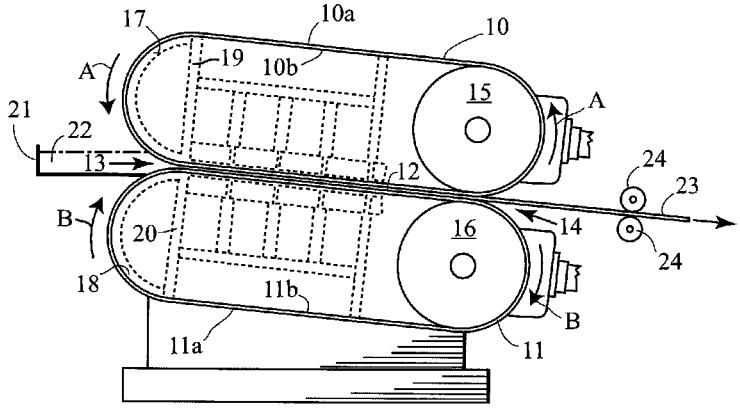
FIG. 1 is a schematic side view of a twin-belt caster with which exemplary embodiments of the present invention may be employed.

Referring to the accompanying drawings, a simplified side view of a twin-belt casting machine is shown in FIG. 1 as an example of an apparatus to which embodiments of the present invention may relate. It should be kept in mind that the following description of a twin-belt caster is provided as an example only and that embodiments of the invention may relate to other kinds of casters, e.g. rotating block casters, twin-roll casters, and the like.

The twin-belt caster shown in FIG. 1 includes a pair of resiliently flexible, heat-conductive metal bands, forming upper and lower endless casting belts 10 and 11 each having outer casting surfaces 10*a* and 11*a*, respectively, and inner or rear surfaces 10*b* and 11*b*, respectively. These belts rotate in looped paths in the directions shown by arrows A and B so that, in traversing a region where the casting surfaces are positioned close together (i.e. forming a closely-spaced confronting section), the casting surfaces 10*a* and 11*a* of the belts define therebetween a casting cavity 12 extending from a molten metal inlet 13 to a solid slab discharge outlet 14. The casting cavity 12 is of uniform height throughout or narrows slightly in the direction from inlet 13 to outlet 14. The belts 10 and 11 are respectively driven and rotated away from each other by large drive rollers 15 and 16, only to approach each other again at the inlet 13, after passing around curved bearing structures, respectively shown at 17 and 18. Supporting carriage structures 19 and 20 are provided for the respective belts 10 and 11, while the drive rolls 15 and 16 are appropriately carried and connected to suitable motor drives, all by well known means.

Molten metal 22 is fed to the casting cavity 12 through the inlet 13 by any suitable means, e.g. from a trough or launder 21 supplied continuously with molten metal from a furnace, or via a molten metal injector, e.g. of the kind disclosed in U.S. Pat. No. 6,725,904 which issued to Desrosiers et al. on Apr. 27, 2004 (the disclosure of which patent is specifically incorporated herein by this reference). As the molten metal in the casting cavity 12 moves along with the belts, it is continuously cooled and solidified, from the outside to the inside, from its contact with the confronting casting surfaces 10*a* and 11*a* of the belts, so that a solid, cast slab 23 of indefinite length is continuously withdrawn and expelled from the outlet 14 of the casting cavity. Further apparatus (not shown, except for supporting pinch rolls 24), is provided for further processing of the slab in conventional ways.

In the region of the casting cavity 12, the inner surfaces 10*b* and 11*b* of the casting belts, i.e. the opposite side surfaces to the casting surfaces, are cooled by contact with a coolant so that heat from the metal may be withdrawn through the casting surfaces 10*a* and 11*a*. Convenient means for both supporting and cooling the inner surfaces of the belts may take the form of a series of cooling "pads" which contain passages for coolant, e.g. water, under pressure leading to a multiplicity of outlet nozzles arranged so as to cover the area of each coolant pad facing the inner surface of each belt. There is a slight spacing between the coolant pads and the adjacent inner surfaces of the belts caused by the coolant issuing under pressure from the nozzles. Consequently, streams of liquid coolant flow between the nozzle faces and the inner belt surfaces to create an efficient cooling action. The coolant is then carried away through appropriate discharge means. An example of nozzles suitable for this purpose are those having a generally flat belt-supporting face of hexagonal outline, e.g. as described in U.S. Pat. No. 4,193,440, which issued to Thorburn et al. on Mar. 18, 1980 (the disclosure of which patent is specifically incorporated herein by this reference).

Figure 2:
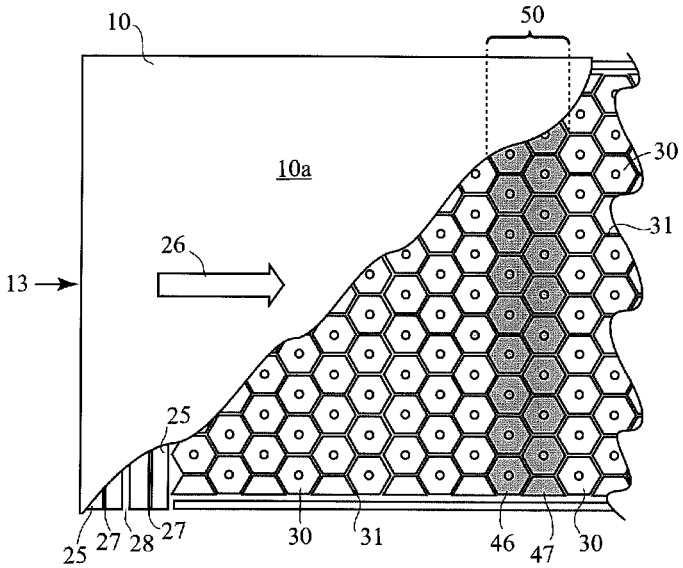
FIG. 2 is a partial top plan view of the lower casting belt of the apparatus of FIG. 1 with the casting belt shown partially torn away to reveal supports and coolant nozzles beneath the belt.
Figure 3A:
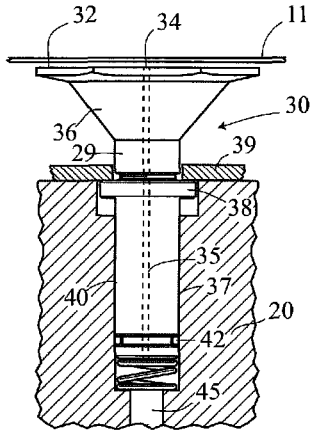
FIG. 3A is a side view of a single support and cooling nozzle of the kind shown in FIG. 2.
Figure 3B:
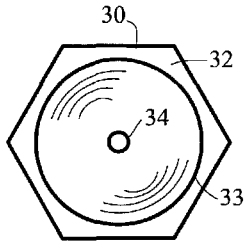
FIG. 3B is a top plan view of the same.

A suitable arrangement of this kind is shown in FIG. 2, which is a partial plan view from below looking up at the upper casting belt 10 of FIG. 1 in the region of the inlet 13 (the lower belt 11 having been omitted from this view for the sake of clarity). The belt 10 is shown partially torn away to reveal the structure above. At the inlet 13, two elongated cooling and support nozzles 25 are provided above the belt 10. These nozzles are arranged transversely to the casting direction 26 of the apparatus and are each provided with central narrow slit 27 through which cooling water is expelled under pressure to provide cooling, support and lubrication for the overlying belt 11. The nozzles 25 are spaced slightly from each other to form a narrow gap 28 through which the cooling water may flow when clear of the nozzle surfaces. Immediately following the transverse nozzles 25 in the casting direction is an array of hexagonal nozzles 30 closely packed together in a honeycomb-like arrangement but nevertheless spaced slightly from each other to provide narrow gaps 31 required for coolant removal. This array of nozzles forms a cooling and support pad for the belt 10. An example of an individual hexagonal nozzle 30 is shown in more detail in the side view of FIG. 3A and the plan view of FIG. 3B together with immediately surrounding structure. These figures illustrate a nozzle used to support and cool the lower casting belt 11, although the nozzles for the upper belt 10 are the same, except as described below. The nozzle 30 has a horizontal hexagonal face 32 provided, as shown in FIG. 3B, with a slight circular depression 33 dished inwardly towards a central opening 34 forming the outer end of an internal axial bore 35 provided for delivery of coolant under pressure to the hexagonal face 32. The face 32 forms the upper surface of a head structure 36 which tapers inwardly to an integral stem 37 via an integral collar 29 at the head of the stem. An enlarged encircling stop ring 38 is provided beneath the collar to engage beneath a stop-plate 39 secured to part of the adjacent support carriage structure 20. This limits the extent of movement of the nozzle 30 towards the overlying casting belt 11. The stem 37 is received in a vertically slidable and rotatable fashion within a passage 40 provided in the structure 20. The stem 37 has an encircling groove 41 for receiving an elastomeric O-ring 42 adjacent to the lower end of the stem. A supporting coil spring 43 is positioned below the stem 37 so that the nozzle 30 may move inwardly slightly to avoid damage if subjected to unusual force from the belt 11 during operation, while normally being held firmly against the stop plate 39 and thus at a fixed distance from the belt. The passage 40 is fed with coolant liquid under suitable pressure from a narrow extension 45, and the coolant flows under pressure through the bore 35 in the nozzle to the hexagonal face 32. The inner surface 11*b* of the casting belt is therefore supported and cooled by the nozzle 30 and a narrow film of the coolant liquid flowing over the outer face 32 of the nozzle.

Figure 4:
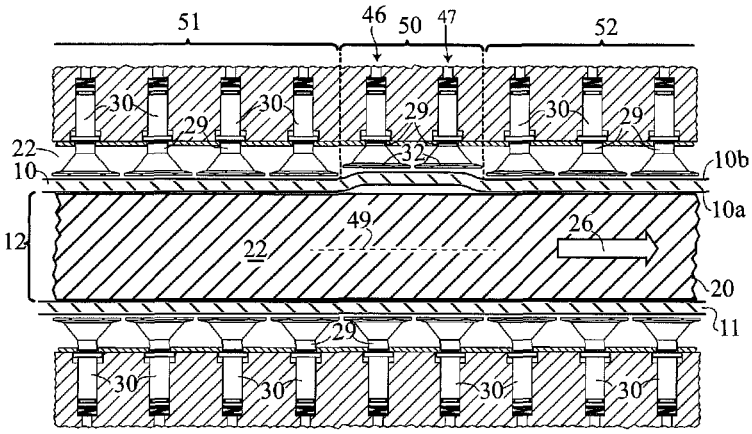
FIG. 4 is a simplified partial side view of a casting cavity of the kind shown in FIG. 1 including casting belt supports and cooling nozzles as shown in FIGS. 3A and 3B, according to one embodiment of the invention.

FIG. 4 is a partial side view in cross-section of a mid-region of the casting cavity and casting belts of FIG. 1 employing the support and cooling equipment of FIG. 2, the cross-section having been taken in a vertical plane orientated in the casting direction 26. The figure is slightly simplified in that it shows the nozzles 30 all aligned in the same vertical plane (i.e. the plane of the paper) whereas, as will be apparent from FIG. 2, adjacent nozzles are in fact staggered slightly towards and away from the observer in this view and should be shown with a slight overlap. FIG. 2 highlights, by means of shading, two adjacent transverse rows of nozzles 46 and 47 in a region 50 of the casting cavity. As shown in FIG. 4, the nozzles 30 forming these rows 46 and 47 above casting belt 10 have much shorter collars 29 than the nozzles of the other rows both above casting belt 10 and below casting belt 11. The shorter collars cause the hexagonal faces 32 of these nozzles to be positioned further away from the conventional plane of the casting belt 10 than the hexagonal faces of the other nozzles. As the belt 10 traverses these two rows, it is pulled towards the nozzles in this region and is therefore pressed less firmly against the metal 22 in the casting cavity 12 and may, depending on the flexibility of the belt and other factors, move temporarily away from the metal as shown (in an exaggerated manner) in the Figure. Full support of the belt and contact with the metal is again provided by the nozzles on the downstream side of the rows 46 and 47 in the direction of casting, as shown. Hence, the region 50, where the hexagonal faces 32 of the nozzles are offset slightly from the central plane 49 casting cavity, is positioned between two regions 51 and 52, respectively upstream (closer to inlet 13) and downstream (closer to outlet 14) of the casting cavity, where the faces 32 of the nozzles are all generally coplanar and are positioned firmly in contact with the inner surface 10*b* of the belt (except for spacing created by the coolant passing under pressure over the surfaces of the nozzles).

The ability of the casting surface 10*a* of the belt to remove heat from the metal 22 is reduced by the reduced pressing effect caused by the offset of the nozzles 30 in the region 50 compared to that in the adjacent regions 51 and 52. It is found that the effect on the ability of the casting surface 10*a* to extract heat from the metal in the casting cavity is reduced quickly as the offset from the central plane 49 of the cavity is increased, but beyond a certain offset distance, little or no further reduction of heat extraction may be attained. It is theorized that the cooling effect of the casting belts ceased to be apparent once the belts are moved a certain distance from the metal. In general, it is found sufficient to displace the nozzles 30 by as little as 1 mm (0.040 inch), and more preferably 0.5 mm (0.020 inch), from the plane of nozzle faces in the adjacent regions. Minimal displacement is also advantageous because the movement of the casting belt may become unstable if the nozzles are displaced by greater amounts. In general, the remainder of the nozzles faces are all held coplanar to the extent possible, both for the upper and the lower casting belt, so that the upper and lower boundaries of the casting cavity 12 are each essentially planar in all other regions of the cavity, even though the upper and lower boundaries may be made to converge slightly in the downstream direction to compensate for contraction of the metal 22 as it cools and solidifies.

The displacement of the nozzle faces 32 in rows 46, 47 reduces the ability of the casting surface 10*a* to withdraw heat from the adjacent metal 22 within the region 50, i.e. the heat flux through belt 10 is reduced from what it would otherwise have been in this region if the nozzle faces had been maintained in the same plane as those of the other nozzles. It is theorized that this temporary reduction in the ability of the casting surface 10*a* to remove heat from the metal causes the temperature of the adjacent outer surface of the metal 22 in this and an immediately following region to increase because heat may transfer from the center of the cast metal towards the surface without the heat being withdrawn immediately by the casting surface 10*a*. Thus, when this part of the metal moves downstream to the adjacent region 52, where the casting belt is in firm contact with the metal surface, there is a greater temperature differential between the metal surface and the casting surface 10*a* than would otherwise have been the case. This greater temperature differential causes heat to be extracted more efficiently in the downstream region 52 of the casting cavity than would otherwise have been the case. Surprisingly, this reduction and then increase in the rate of heat extraction (i.e. heat flux) results in a noticeable improvement of the overall efficiency of the casting procedure compared to an equivalent casting procedure carried out with no offset of the nozzle faces in any region of the casting cavity. The metal slab therefore exits the casting cavity at a lower temperature than in the equivalent conventional casting procedure, which means that the casting cavity may be reduced in overall length and/or the casting speed may be increased to restore the exit temperature of the metal slab to the same value as in the equivalent conventional procedure. This can produce economies of equipment manufacture, casting time and possibly coolant usage.

Figure 5:
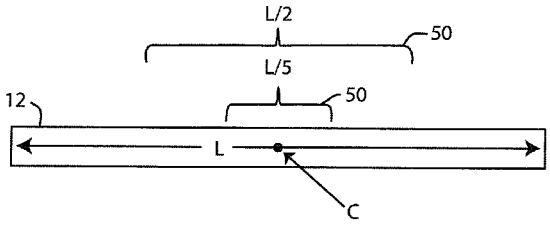
FIG. 5 is a simplified representation of a casting cavity showing preferred locations of regions having reduced ability to extract heat from the metal cast in the cavity.

By increasing or decreasing the number of nozzle rows having the increased offset, the size of the region 50 (i.e. distance extending in the casting direction) can be varied. Similarly, by varying the choice of the particular rows provided with the offset, the position of the region 50 along the casting cavity can be changed. Furthermore, by choosing to offset nozzles adjacent to the top belt 10 (as shown) and/or the bottom belt 11, the heat flux can be varied either through the top surface and/or the bottom surface of the cast metal slab. It is found in general that the size of the offset region (distance in the casting direction), may effectively be from 10 to 50% of the total length of the casting cavity (distance from inlet to outlet), and is preferably from 10 to 20% of the cavity length. As for the positioning of the region 50, preferably it should not start so close to the cavity inlet that the solidified metal "shell" forming on the outer surfaces of the metal re-melts under the influence of heat from the interior, as this may cause an undesirable wave-like pattern to form on the surface of the metal slab. On the other hand, if the region 50 is positioned too close to the cavity outlet, the reheating effect from the interior of the slab may be too slight to reheat the surface of the slab to the desired extent, as the metal of the interior may then be quite cool. In general, the region is located at the middle ½ of the cavity, more preferably the middle ⅕ of the cavity. This is illustrated in FIG. 5 which shows a representation of a casting cavity 12 having a length "L" with a center point "C" mid way along the cavity in the casting direction. The region 50 with offset nozzles is preferably centered on the mid point "C" and may extend for one fifth of "L" to one half of "L", as shown.

As noted, the region 50 of offset nozzles may be provided for only one or for both of the casting belts. When the nozzles of both belts have offsets, they may be positioned at the same distance along the casting cavity and have the same lengths, or they may have different positions and/or lengths. If the slab temperature is not symmetrical about its horizontal central plane 49 (which is often the case, given the tendency of gravity to maintain a firmer contact of the metal with the bottom belt and thus greater heat flux), there is no compelling reason to have the heat flux variation made symmetric about this plane. To the contrary, it may be better to vary the position and length of the offset region 50 for the top and bottom belts with a view to achieving the same rate of heat flux improvement on each side of the slab. Furthermore, the region 50 of offset nozzles may extend fully across the width of the casting cavity (the direction transverse to the casting direction) or only partway across. In practice, the rate of heat extraction varies across the width of the casting cavity, so the region 50 may be made to extend only part way across the casting cavity and positioned to equalize heat flux across the slab as much as possible. For ease of implementation, however, the region is preferably made to extend fully across the width of the casting cavity.

In the casting apparatus, the nozzles may be permanently offset in the region 50 or some (e.g. those in central regions) or all of the nozzles may be adjustable so that some can be offset from the others when desired and in an amount desired according to particular casting conditions or metals being cast. A permanent offset is achieved by providing nozzles 30 having collars 29 of different lengths. An adjustable offset may be achieved, for example, by providing some of the nozzles with telescoping collars of adjustable length and providing such nozzles with mechanical or hydraulic means for adjusting the lengths of such collars when desired.

In the above exemplary embodiment, the casting surfaces in zone 50 are provided with a reduced ability to extract heat from the metal in the casting cavity by offsetting the positions of the support and cooling nozzles, but a reduction of the ability to extract heat may be achieved in alternative ways. For example, the flow of coolant through the nozzles in the affected region 50 may be reduced, or even terminated, compared to that in the other regions. Although complete termination of the coolant flow is possible, it is not generally desirable because of the increased friction between the belt and the nozzle face that might then occur. Furthermore, a change in the supply pressure of the coolant, or the internal pressure of the apparatus, may affect the degree of elevation of the casting belt from the support surface of the affected nozzle. Another alternative is to raise the temperature of the coolant in the affected region compared to that in the other regions. A further alternative is to insulate the casting belt from the coolant, e.g. by introducing a gas between the casting belt and the coolant.

The following EXAMPLES are provided to illustrate the invention further. However, they should not be considered to limit the general scope of the present invention in any way.

EXAMPLE 1

Experiments were carried out on a laboratory scale twin-belt caster (referred to as "TB2"). The caster had a design generally as shown in FIGS. 1 and 2, and had a casting cavity with a length similar to that of commercial-scale, twin-belt casters; however, the width of the casting belts was smaller than that of commercial casters. The caster was provided with nozzles of special design that allowed all of the cooling nozzles to be adjusted to change their offset spacing from the casting cavity so that the effects of increasing the offset in different regions or for different region sizes could be assessed. The exit temperature of the slab was measured using five contact thermocouples spaced across the bottom of the emerging slab near the outlet of the casting cavity. Heat flux in the caster was monitored using an array of cooling water thermocouples.

An experiment was conducted with nozzles offset by 1 mm in a central region of the caster, i.e. the second and third row of nozzles immediately following the linear nozzles, on the upper belt carriage. Each row of hexagonal nozzles was approximately 3.3 cm long (in the direction of casting). Allowing for the interleaving of the rows due to the close packing, the region of the caster affected was a band approximately 16.2 to 21.6 cm downstream from the point of molten metal injection. For comparison, experiments were also carried out in which the last three rows of nozzles of the casting cavity were offset each by 1 mm on the upper and lower belt carriage, which had the effect of shortening the casting cavity by about 10 cm, leaving a parallel (normal) casting section of about 50 cm in length.

The alloy cast in the experiments had a nominal composition of 0.68 wt. % Si, 0.58 wt. % Fe, 0.21 wt. % Cu and 0.77 wt. % Mn, balance Al, at a 10 mm gauge for all of the experiments. The casting belts had shot-blasted surfaces.

Table 1 below lists the experimental casts in their order of completion and the corresponding nozzle configurations.

TABLE 1

| CAST NO. | DEPRESSED NOZZLE LOCATION | FRONT END INDICATED HEAT FLUX ($MW/m^2$) | EXIT TEMPERATURE[1] RANGE AT 3 m/min (° C.) |
|---|---|---|---|
| 921 | Baseline | 6/7 | 410-475 |
| 922 | Baseline | 5.5/7 | 455-480 |
| 923 | Last three rows, Bottom carriage | 4.0/3.1 | 445-500 |
| 924 | Last three rows, Top carriage | 8.4/4.5 | 420-470 |
| 925 | Baseline | 3.4/3.0 | 410-460 |
| 926 | Baseline | 6.1/4.5 | 390-440 |
| 927 | Baseline | 6.7/5.5 | 425-480 |
| 928 | Last three rows, Bottom carriage | 6.7/4.9 | 455-485 |
| 929 | Last three rows, Top carriage | 4.4/3.9 | 285-350 |

[1]bottom surface, before pinch roll.

Figure 6:
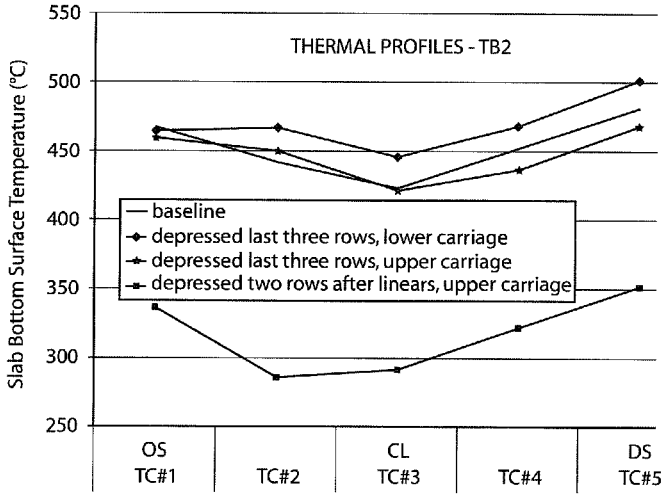
FIG. 6 is a graph showing the exit temperatures at positions across cast slabs emerging from the casting cavity under the test conditions explained in the section entitled Examples below.

FIG. 6 is a graph showing the exit temperatures measured across the width of the slab in each case. In the drawing, "OS" means operator side (of the casting machine), "CL" means center line and "DL" means drive (side of the casting machine). Additionally, "TC" means thermocouple, and "TC#1", "TC#2", . . . etc. refer to the thermocouples arrayed across the emerging slab from the "OS" to the "DS".

As can be seen from Table 1 and FIG. 6, the exit temperature range for the experiment in which the rows in the central part of the casting cavity were depressed (run 929) was surprisingly much lower than that of any of the other experiments, including both baseline runs (no depression of any nozzles) and runs in which the exit nozzles were depressed. The latter modification did not seem to have much effect on the exit temperatures.

Figure 7A:
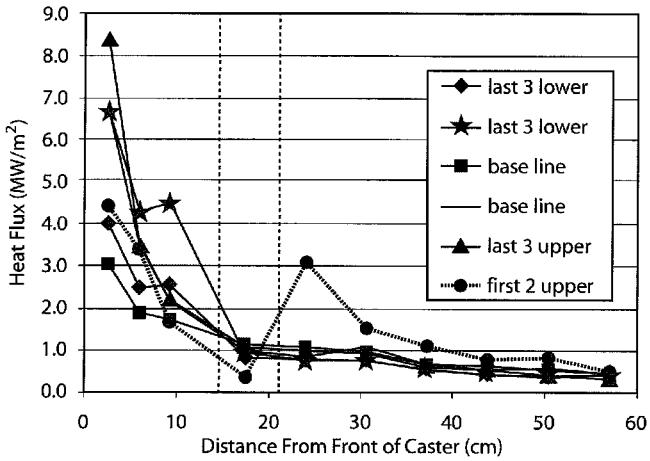
FIG. 7A is a graph showing heat flux results through the top belt of a twin belt caster at various distances along the casting cavity for casting runs in which the positions of the supports for the casting belts were varied in different regions of the casting cavity.
Figure 7B:
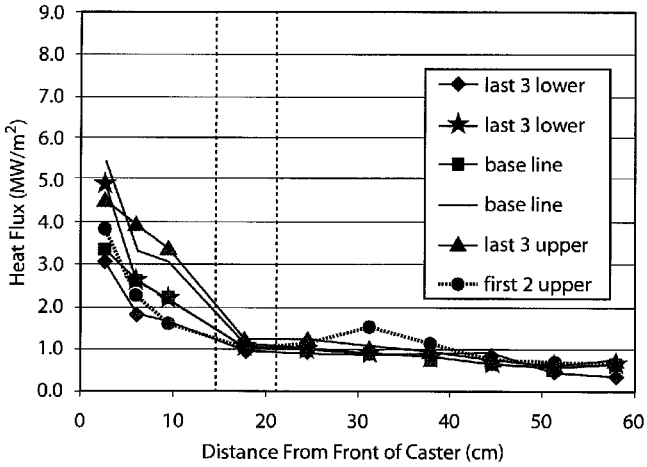
FIG. 7B is a similar graph showing the heat flux through the bottom belt for the same casting runs, under conditions explained in the section entitled EXAMPLES below.

FIGS. 7A (top belt) and 7B (bottom belt) of the accompanying drawings are graphs illustrating the top and bottom belt heat flux profiles down the full length of the centre of the caster, including the cast during which the first two rows of hexagonal nozzles (about one-third of the distance along the caster cavity) were depressed in the upper carriage. As might be expected, the top belt heat flux was reduced in the area in which the offset nozzles of the upper belt carriage pulled that casting belt away from the normal belt plane. Surprisingly, the heat fluxes in the region following that in which nozzles were depressed were significantly increased in both the top and the bottom belts. FIG. 7A shows that about a 60% reduction in heat withdrawal in the offset nozzle zone led to an approximately three-fold increase in heat withdrawal in the immediately following zone. This is a very surprising result. The effect of offsetting the nozzles at the end of the casting cavity had a less pronounced effect.

Effect of Depressed Nozzles on Caster Cavity Shape

Generally, it was observed that installing the depressed nozzles (offset by 1 mm) near the center of the caster increased the gap between the two casting belts by about 0.4 mm in the area with depressed nozzles, with the belt returning to its normal elevation after passing the area with depressed nozzles.

At the exit end of the caster, the effect of depressing nozzles was more pronounced. At the front edge of the depressed region, the gap between casting belts was increased by the same 0.4-0.5 mm. However, as the last rows of nozzles are positioned immediately before the 'break' in the belt path (where the belts normally diverge significantly), the change in the gap between belts was more pronounced in the downstream section of where these nozzles were depressed. The general effect was to decrease the effective length of the caster cavity as though the break in the caster belt path had been moved forward.

The effect on cavity size of depressing nozzles at the exit of the top carriage was the same as that of depressing nozzles at the exit of the bottom carriage.

EXAMPLE 2

The results described in Example 1 were achieved by modulating the heat flux in part of the caster by mechanically adjusting the nozzle elevations in that region to remove the belt from contact with the slab being cast. However, there are other means of achieving the same or similar results without resorting to mechanical means, as illustrated in this prophetic Example.

The caster described above includes a plurality of cooling nozzles beneath the casting belts which supply high pressure water to cool and position the casting belts. The application of the cooling water, its supply pressure and distribution and the internal pressure maintained within the casting machine are all process parameters which determine the velocity of the cooling water across the inner face of each casting belt and hence the belt elevation and the heat extraction rate. These parameters are conventionally controlled for the whole casting machine as it was not considered to be economically feasible to modify an existing machine to operate in such a way that part of the nozzle array could be operated under different pressure/flow condition than the rest of the machine.

However, in this Example, the conventional casting machine is modified to provide zoning of the cooling nozzle array for at least one of the casting belts, i.e. different zones are provided in which the above parameters are controlled independently. Thus, the apparatus has a central part of the cooling array, similar to that described in the above example, operated successively with reduced water pressure, water flow and water velocity conditions. The adjustment of these parameters provides an effect of locally reducing the heat extraction rate and achieving the same effect on the final exit temperature and slab condition as that achieved by moving the nozzles in Example 1. Modifications to the internal pressure of the caster locally, will also achieve the same result.

What is claimed:

1. A method of continuously casting a metal slab, comprising:

a. continuously introducing molten metal into an inlet of a casting cavity defined between spaced confronting casting surfaces advancing in a direction of casting;

b. providing said casting surfaces with an ability to remove heat from said molten metal in said casting cavity to cause said molten metal to solidify and thereby form a fully- or partially-solid metal slab within the casting cavity;

c. continuously discharging said metal slab from said casting cavity through an outlet of said casting cavity; and d. reducing said ability of at least one of said casting surfaces to remove heat from the molten metal in a region of said cavity spaced from both said inlet and said outlet between immediately upstream and downstream regions of said casting cavity and extending transversely to said direction of casting, said ability of said at least one of said casting surface in said region being reduced relative to said ability of said at least one casting surface to remove heat from said immediately upstream and downstream regions of said casting cavity wherein said casting surfaces each form one side of a heat-conductive member also having an opposite side, and said ability of said casting surfaces to remove heat is provided by supplying a liquid coolant to said opposite side of the heat-conductive cooling member, and wherein said ability of said at least one of said casting surfaces to remove heat is reduced by at least partially insulating said opposite side of said member from said liquid coolant in said region while avoiding said at least partial insulation in said immediately upstream and downstream regions.

2. The method of claim 1, wherein each heat-conductive member is supported by supports acting against said opposite side, and wherein said ability of said at least one casting surface to remove heat from said region of said casting cavity is reduced by offsetting said supports in said region by a distance from a central plane of said casting cavity relative to said supports in said immediately upstream and downstream regions.

3. The method of claim 2, wherein said supports in said region are offset by an amount of at least 0.5 mm relative to said supports in said immediately upstream and downstream regions.

4. The method of claim 2, wherein said supports in said region are offset by an amount of 1 mm±25% relative to said supports in said immediately upstream and downstream regions.

5. The method of claim 1, wherein said ability of said at least one of said casting surfaces to remove heat is reduced by increasing a temperature of said liquid coolant supplied to said opposite surface of said member in said region compared to liquid coolant supplied to said opposite surface in said immediately upstream and downstream regions.

6. The method of claim 1, wherein said ability of said at least one of said casting surfaces to remove heat is reduced by reducing a rate of flow of said liquid coolant supplied to said opposite surface of said member in said region compared to a rate of flow of said liquid coolant in said immediately upstream and downstream regions.

7. The method of claim 1, wherein said ability of said at least one casting surface to remove heat is reduced in said region by enabling said casting surface to move further from a central plane of said casting cavity in said region than in said immediately upstream and downstream regions.

8. The method of claim 1, wherein said region has a distance in said casting direction of one fifth to one half of a length of said casting cavity from said inlet to said outlet.

9. The method of claim 8, wherein said region is centered on a mid-point of said casting cavity between said inlet and said outlet.

* * * * *

UNITED STATES PATENT AND TRADEMARK OFFICE

CERTIFICATE OF CORRECTION

PATENT NO. : 8,813,826 B2
APPLICATION NO. : 14/105943
DATED : August 26, 2014
INVENTOR(S) : Kevin Michael Gatenby and Edwin Stanley Luce It is certified that error appears in the above-identified patent and that said Letters Patent is hereby corrected as shown below:

On the Title Page
Item 72, "Kevin Michael Gatenby, Kingston, CA (US); Edwin Stanley Luce, Kingston, CA (US)" should be changed to --Kevin Michael Gatenby, Kingston, ON (CA); Edwin Stanley Luce, Kingston, ON (CA)--.

Signed and Sealed this
Nineteenth Day of May, 2015

Michelle K. Lee

Michelle K. Lee
*Director of the United States Patent and Trademark Office*